United States Patent [19]

Modliszewski

[11] 3,942,451

[45] Mar. 9, 1976

[54] MULTIPLE COUPLER ENGAGING HEAD FOR RAILROAD CAR POSITIONER

[75] Inventor: Francis R. Modliszewski, Chagrin Falls, Ohio

[73] Assignee: McDowell-Wellman Engineering Company, Cleveland, Ohio

[22] Filed: Dec. 5, 1974

[21] Appl. No.: 529,717

[52] U.S. Cl. ..... 104/176; 104/162; 213/224

[51] Int. Cl.[2] ..... B61B 9/00; B61J 3/06

[58] Field of Search..... 104/176, 162, 26 R, 26 A, 104/50; 105/27; 213/224, 79; 214/52 R, 52 B, 52 C

[56] References Cited

UNITED STATES PATENTS

| | | | |
|---|---|---|---|
| 3,169,490 | 2/1965 | Saxonmeyer | 104/176 |
| 3,262,399 | 7/1966 | Ludwig | 104/176 |
| R27,300 | 2/1972 | Ludwig | 104/176 |

*Primary Examiner*—Robert J. Spar
*Assistant Examiner*—Randolph A. Reese
*Attorney, Agent, or Firm*—McNenny, Farrington, Pearne & Gordon

[57] ABSTRACT

There is provided, in a railroad car positioning apparatus of the general type shown and described in Reissue Patent No. Re. 27,300 dated Feb. 22, 1972, an improvement in the car positioner arm which is adapted to move between a pair of coupled railroad cars and into car pushing engagement with the cars centrally thereof. The improvement involves the provision, in combination, of force transferring means on the distal extremity of the car positioner arm for engaging a coupled coupler between a pair of coupled railroad cars, separate force transferring means also on the distal extremity of the car positioner arm for engaging an open coupler of at least one uncoupled railroad car, and means for shifting the two force transferring means for selectively disposing either of them in its operative, car-manipulating position and the other in a stored or inoperative position.

14 Claims, 9 Drawing Figures

11

11

MULTIPLE COUPLER ENGAGING HEAD FOR RAILROAD CAR POSITIONER

BACKGROUND OF THE INVENTION

This invention relates to railroad car positioning apparatus for moving one or more railroad cars along a track to a car unloading facility and involving a carriage movable parallel to the track at one side thereof and carrying means for engaging a single car or a train of coupled cars for advancing them to a predetermined position on the track. Typical prior art installations of this character are shown in the U.S. Pat. Nos. 3,695,185 to Blank, granted Oct. 3, 1972; No. 3,169,490 granted Feb. 16, 1965, to Saxonmeyer; No. 2,199,470 granted May 7, 1940, to Taylor; and No. 1,125,355 granted Jan. 19, 1915, to Lovell. The utility of such prior art car positioners was limited by the fact that they could not operate effectively both to move a single car or a train of two or more coupled cars from one end thereof and, also, to move a train of coupled cars by engaging the train between the cars. In the same coal unloading terminal, some trains to be unloaded may be of the "unit train" type, which are intended to remain coupled during unloading, and some trains may be made up of random railroad cars not equipped for unit train operation so that they must be uncoupled for unloading individually or in pairs, according to the character and capacity of the car unloader.

A more recent development in railroad car positioners is shown in U.S. Pat. No. Re. 27,300 granted Feb. 22, 1972, to Ludwig. The apparatus of that patent constituted an improvement on the apparatus of the aformentioned prior patents by providing means on the carriage for engaging a train of railroad cars between pairs of coupled cars for moving the entire train as required in the handling of trains of the aforementioned unit train type.

The present invention is an improvement in railroad car positioning apparatus of the type shown in the last-mentioned reissue patent to Ludwig and concerns the train engaging portion of the means on the carriage for engaging and moving the cars of a train. Unlike the apparatus of that prior patent to Ludwig, the coupler engaging assembly of the present invention is not only adapted for use between coupled railroad cars of the unit train, but is also adapted for use at either end of a single car or pair of coupled cars and between a pair of uncoupled cars in a versatile manner that enables a train of random cars to be advanced stepwise into and through a dumper, either one or two at a time according to the dumper capacity.

SUMMARY OF THE INVENTION

The apparatus of the present invention includes the following principal elements of the apparatus of the aforementioned patent to Ludwig: A carriage disposed for movement parallel to a railroad track; means for guiding the carriage alongside the track; a swingable car positioner arm mounted on the carriage for rotation on an axis parallel to the track, the distal extremity of this arm being configured and dimensioned to be positioned between coupled railroad cars in car pushing engagement with the cars centrally thereof; and means for selectively moving the car positioner arm into and out of car pushing position. The improvement of the present invention provides, in combination, a force transmitting assembly on the distal extremity of the car positioner arm for engaging the engaged couplers of a pair of coupled railroad cars; separate force transmitting means on the distal extremity of the car positioner arm for engaging an open coupler of at least one uncoupled railroad car; and means for shifting said force transmitting means selectively to dispose either of them in its operative car pushing position and the other in a stored or inoperative position.

Throughout this specification and appended claims, reference is made from time to time in general terms, to bringing a car pusher arm, or means mounted thereon, into engagement with a railroad car centrally thereof. As such expressions are used herein, the coupler of a car is considered to be a part of the car to which it is operatively attached. Thus, the engagement referred to may be engagement with a coupler of one car, or with the mating couplers of a pair of coupled cars, or with a part of the frame of a car, such as a striker plate mounted thereon.

BRIEF DESCRIPTION OF THE DRAWINGS

An illustrative and preferred embodiment of the present invention is shown in the annexed drawings with views depicting a typical environment in which it is suitably employed. In the drawings:

FIG. 6 is a plan view of the car engaging device of FIGS. 4 and 5, similarly disposed between adjacent cars of a unit train (partially shown in phantom outline).

FIG. 9 is a plan view of the car engaging device of FIGS. 4 – 6 with the two force transmitting assemblies disposed as in FIGS. 7 and 8.

DETAILED DESCRIPTION OF THE INVENTION

Figure 1:
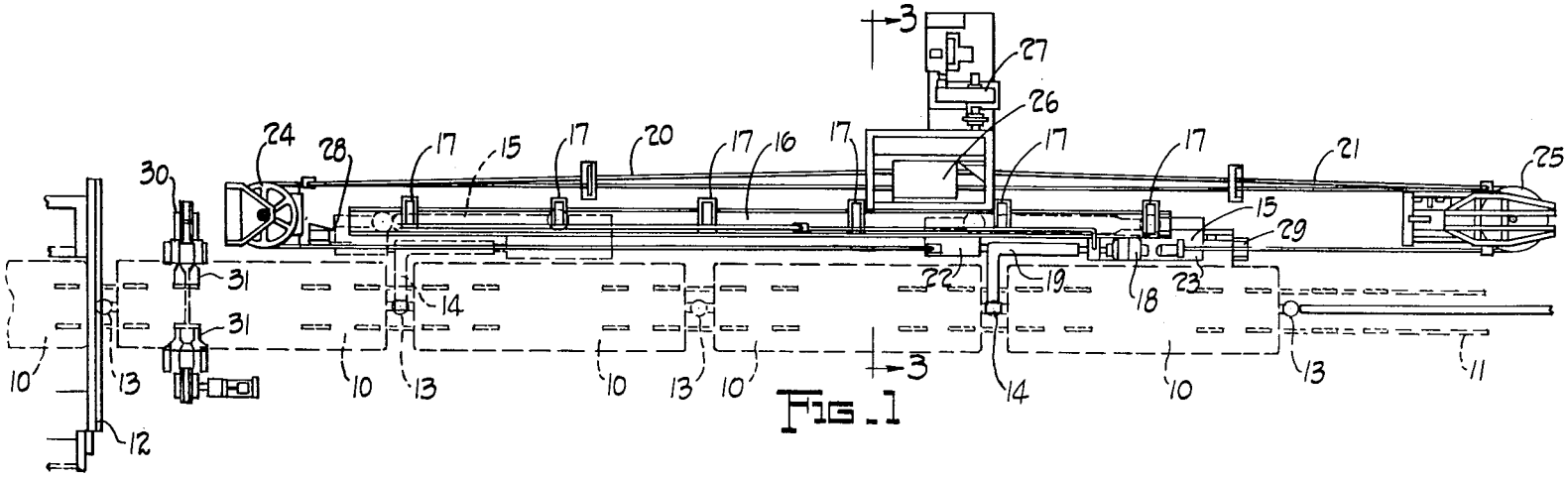
FIG. 1 corresponds to FIG. 1 of the aforementioned Pat. No. Re. 27,300 to Ludwig, and is a top plan view of a railroad car positioning apparatus with which the improvements of the present invention are preferably used and, in general arrangement, of a series of coupled railroad cars and their tracks (shown in phantom outline) with a car engaging arm of the car positioning apparatus in an engaged position between a pair of coupled cars to advance the coupled train stepwise into a conventional car dumping facility (partially shown).
Figure 2:
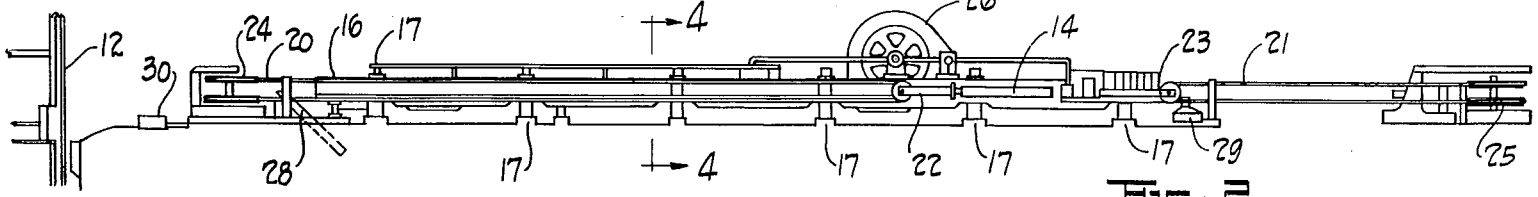
FIG. 2 corresponds to FIG. 2 of said Pat. No. Re. 27,300 and is a side elevation of the car positioning apparatus alone.
Figure 3:
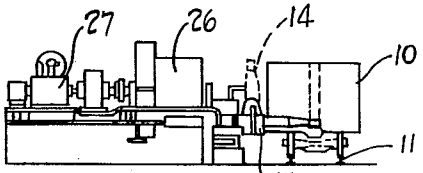
FIG. 3 corresponds to FIG. 3 of said Pat. No. Re. 27,300 and is a cross-sectional view of the car positioning apparatus alone, viewed as indicated by the line 3—3 in FIG. 1, and showing the general arrangement of the car engaging arm and the motive apparatus for moving the carriage on which that arm is mounted.

Referring first to FIGS. 1 – 3 (reproduced from the aforementioned U.S. Pat. No. Re. 27,300), a plurality of railroad cars 10 shown in phantom outline represent a portion of a coupled unit train of gondola-type cars disposed on railroad tracks 11. The tracks 11 lead from right to left into a conventional, rotary, railroad car dumper 12 partially shown in FIGS. 1 and 2. The rotary car dumper 12 forms no part of the present invention and may be replaced by any known railroad car dumping apparatus that is adapted to receive a single railroad car, or a plurality of railroad cars, and to empty such cars. A currently popular type of car dumper, particularly suited for emptying coupled cars in a unit train, inverts the cars by revolving them about a longiudinal axis of the draw bars of the couplers joining the cars. In order to permit such inverting of the coupled cars of a unit train, the couplings are rotatable about that axis so that the car or cars 10 being emptied by the rotary dumper 12 may rotate relative to the other cars of the balance of the train. Such a unit train normally travels as a unit from a remote loading point to and through the unloading apparatus.

If the cars 10 are, however, of random size, type, and/or length, and are equipped with nonrotary couplers, the car or cars moved into the rotary car dumper 12 must be uncoupled from the balance of the train to permit rotation of the car or cars in the dumper.

For moving the cars 10 sequentially into the rotary dumper 12, either while coupled or while uncoupled, they are centrally engaged by a car positioning arm 14 mounted on a carriage 15, and the carriage 15 is adapted to move back and forth along a carriage trackway 16 disposed parallel to the railroad tracks 11. In order for the carriage 15 to be movable a sufficient distance along the carriage trackway 16 for advancing either a unit train or a train of random cars into a dumper capable of receiving two cars simultaneously, the length of the carriage trackway 16 should be at least sufficient to permit movement of the carriage 15 the distance required to move two coupled cars 10 into the dumper in tandem.

The carriage 15 is partially shown in phantom outline in an advanced position at the left-hand extremity of the trackway 16 in FIG. 1, slightly more than the length of two coupled railroad cars in advance of its initial position at the right-hand extremity of the trackway 16. The trackway 16 is supported on a plurality of spaced pedestals 17.

The car positioner arm 14 is swingable from the generally horizontally extending position between a pair of coupled cars shown in FIG. 1 to a generally vertical position clear of the cars to one side thereof. As hereinafter more particularly described, the distal extremity of the car pusher arm 14 carries the car engaging assemblies of the present invention for pushing engagement with the cars 10 so that the pushing force is applied centrally of the cars in a vertical plane that includes the longitudinal axis of the draw bars of the car couplers 13. Any suitable motor 18 or the like may be provided for rotating the car positioner arm 14 about an axis extending longitudinally through a lateral extension 19 thereof and parallel to the trackway 11 for swinging the arm between its generally vertical and horizontal positions. For handling a unit train, engagement and disengagement of the car positioner arm 14 and travel of the carriage 15 along its trackway 16 may be automatically accomplished by any suitable controls programmed according to the length of the cars 10 and the cycle of the car dumper 12.

Movement of the carriage 15 along the carriage trackway 16 is conveniently effected by advancing cables 20 and retracting cables 21 suitably secured to the head extremity 22 of the carriage and the tail extremity 23 thereof, respectively, these cables being reaved through a suitable head sheave 24 and an adjustable tail sheave 25 for coaction with a cable winding drum 26. The drum 26 is powered by a suitable motor 27 or the like. In order to arrest the carriage 15 at the extremities of its stroke along its trackway 16, a head bumper 28 and a tail bumper 29 are provided. Car truck lock means 30 may be provided and may employ retractable wheel chocks 31 adapted to be positioned on the tracks 11 in the nips between the railroad car truck wheels and the tracks 11 both fore and aft the wheels. When so positioned, the wheel chocks 31 prevent movement of a unit train or train of random cars during the car dumping cycle. Any convenient alternative means may be employed for holding a train in a fixed position during the dumping cycle and may be automatically operated in any suitable manner programmed to coordinate with the operation of the car positioning apparatus and the car dumper.

The car engaging assemblies of the present invention, both mounted on the distal extremity of the car positioner arm 14, are shown in detail in FIGS. 4 – 8 in their respective operative positions and in stored, inoperative positions, and in their relationships with the coupled cars of a unit train and with the uncoupled cars of a train of random cars.

Figure 4:
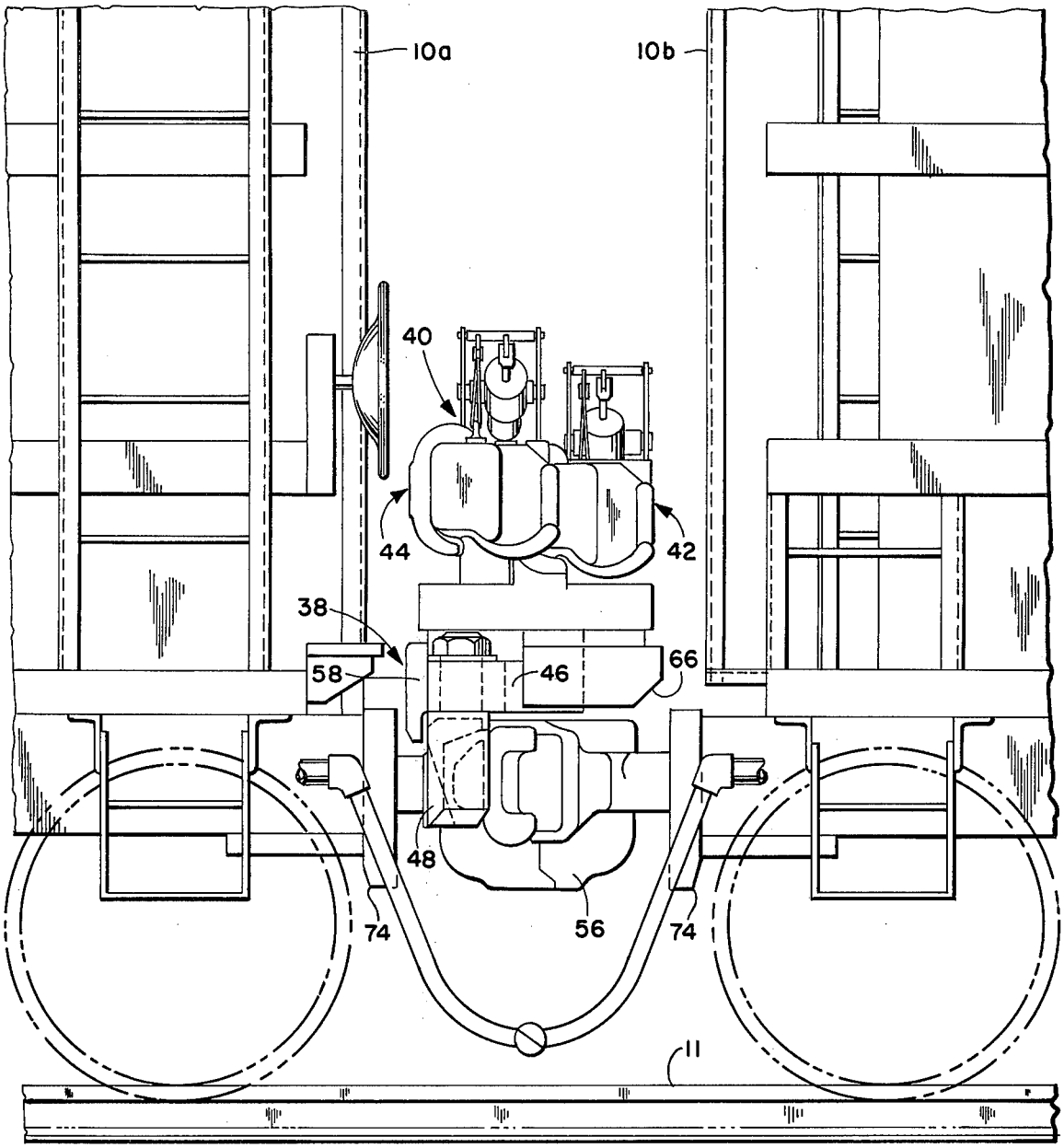
FIG. 4 is an end elevation of a car engaging device in accordance with the present invention, disposed between a pair of coupled railroad cars and including one force transmitting assembly engaging the coupled couplers of the cars and another superposed force transmitting assembly in a stored, inoperative condition and position.
Figure 5:
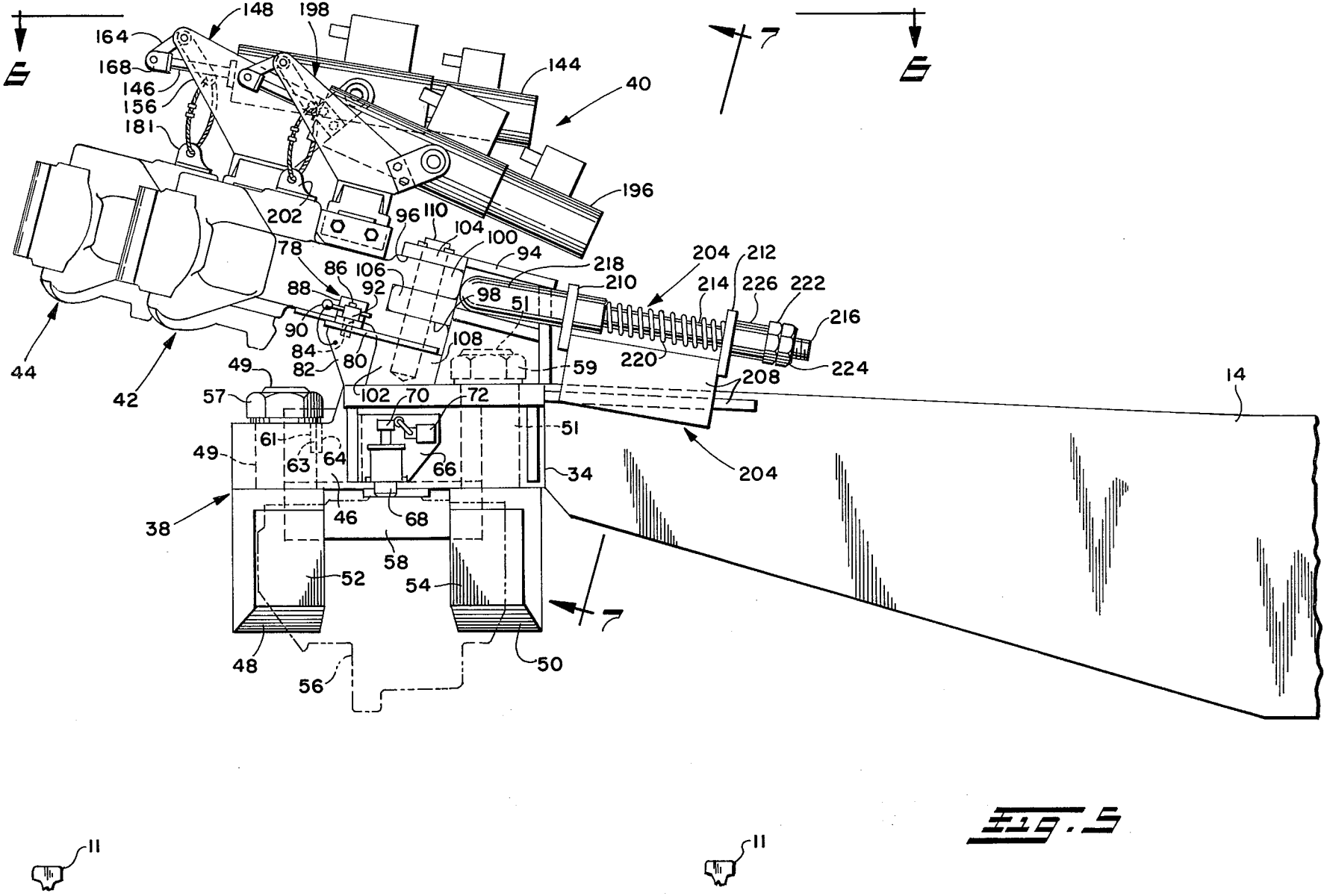
FIG. 5 is a side elevation of the car engaging device of FIG. 4 in the same relationship with the coupled couplers (shown in phantom outline) as shown in FIG. 4.
Figure 5:
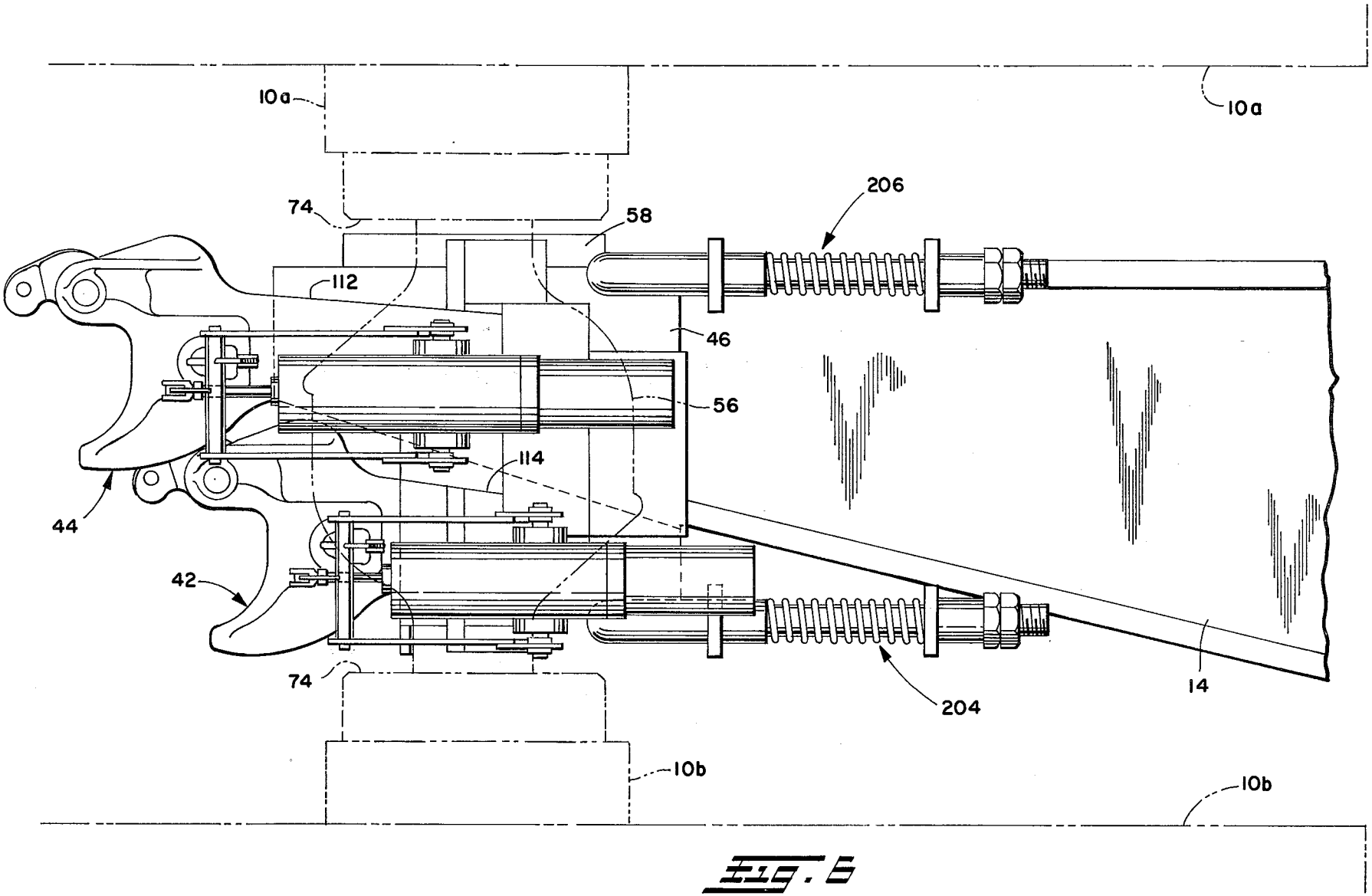

Referring particularly to FIGS. 4 – 6, the car engaging assemblies are there shown as they are disposed in relationship with the coupled cars of a unit train for unit train manipulation, with one of the car engaging assemblies fitted over a coupled rotary coupler assembly of a unit train for moving the train along the tracks 11 and with the other car engaging assembly raised and stored in a folded, inoperative condition. As there shown, the distal extremity 34 of the car positioner arm 14 carries a lower car engaging assembly, generally designated 38, adapted, when lowered to its illustrated, operative position, to fit over a coupled rotary coupler assembly 56 (shown in phantom outline) that connects a pair of unit train cars 10*a* and 10*b*. That extremity of the arm 14 also carries a superposed car engaging assembly, generally designated 40, that comprises a pair of pivotally mounted arm couplers 42 and 44. As shown in FIGS. 4 – 6, the arm couplers 42 and 44 have been swung together into stored positions and, in the illustrated orientation of the car positioner arm 14, are raised to an inoperative location, as hereinafter more particularly described. Since the two car engaging assemblies 38 and 40 engage the couplers of coupled and uncoupled cars, respectively, both are hereinafter sometimes referred to as "coupler engaging" assemblies.

The lower coupler engaging assembly 38 comprises a mounting block 46 having a plurality of depending, pusher fingers 48 and 50 bolted thereto. The pusher fingers 48 and 50 have milled surfaces 52 and 54, respectively, which are adapted to engage mating surfaces of the interlocked coupler assembly 56 in abutting relationship therewith. The surfaces 52 and 54 normally engage the coupler assembly 56 for decelerating a train moving from right to left in FIGS. 1 and 2, or for accelerating a train in the opposite direction if that should be required.

The pusher fingers 48 and 50 are provided with upstanding pin extensions 49 and 51, respectively, which pass upwardly through the mounting block 46 to receive nuts 57 and 59. To prevent undesired rotation of the pushing fingers, each may be provided with a keyway 61 coacting with a key 63 and a mating keyway 64 in the mounting block 46 (not shown on pushing finger 50). Any other suitable means may be employed for blocking the pusher fingers 48 and 50 against such rotation.

The coupler assembly 56, as most completely shown in FIG. 4, is an A.A.R. type "F" interlocking coupler. The coacting components of such a coupler may be mounted on the railroad cars for rotation about their longitudinal draft gear axis so that the cars in a train may be rotated, one or two at a time, about the draft gear axis without being uncoupled from the other cars of the train. However, as will be clear to those skilled in the art, the pusher fingers 48 and 50 may be contoured in any suitable manner for engagement with any kind of coupler encountered in unit train systems.

Also secured to the mounting block 46 of the coupler engaging assembly 38 is a member 58 designed for pushing engagement with a striker plate 74 of the car 10*a* (FIG. 5), the member 58 being suitably secured to the mounting block 46 as by welding. The member 58 engages the striker plate 74 during acceleration of a unit train toward the dumper 12 and thereafter as needed to maintain an acquired train speed.

The mounting block 46 may also carry a bracket 66 (FIGS. 4 and 5) for mounting a limit switch control comprising a feeler 68 adapted to be actuated by contact with the upper surface of the rotary coupler assembly 56 of a unit train as it is being operatively engaged by the coupler engaging assembly 38. Upward actuation of the feeler 68 raises a knocker head 70 for tripping a limit switch 72 that is also mounted on the bracket 66. The limit switch 72 may be connected into any appropriate control circuit (not shown) for energizing and de-energizing the motor 18 to raise and lower the car positioner arm 14 in an appropriately programmed sequence of unit train unloading operations.

Referring next to the upper coupler engaging assembly 40, which is mounted on the distal extremity of the car positioner arm 14 as best shown in FIGS. 5 and 7 – 9, the mounting block 46 is provided with a superposed, inclined, mounting bracket 94 having spaced slots 96 and 98 formed thereon between parallel tongues 104, 106, and 108 of the bracket. The mounting end of the arm coupler 42 of this coupler engaging assembly is provided with projecting, spaced fingers 100 and 102 that are respectively received in the slots 96 and 98 and are pivotally mounted therein by a pivot pin 110 that passes therethrough and through the slot-defining bracket portions 104, 106 and 108 and is locked in place by a retainer 132. The mounting end of the other coupler arm 44 of this coupler assembly is similarly mounted with spaced fingers 120 and 122 thereof pivotally received in slots 116 and 118 of the mounting bracket and hinged therein on a pin 130 locked in place by a retainer 134.

When the car positioner arm 14 is disposed for engaging the lower coupler engaging assembly 38 with the coupled coupler 56 as shown in FIGS. 4 – 6, the arm couplers 42 and 44 of the upper coupler engaging assembly 40 are disposed in a raised, inoperative position with the arm couplers 42 and 44 swung toward each other and extending upwardly at an inclination of about 15°. In order to move the upper coupler engaging assembly 40 to an operative position for coaction with a coupler element at one end of a train or of a single car, or for coaction with both coupler elements at adjacent ends of a pair of adjacent uncoupled cars, the car positioning arm 14 is lowered about 15° to the orientation shown in FIG. 8, whereupon the arm couplers 42 and 44 of the coupler engaging assemblies 40 are manually swung about their respective mounting pins 110 and 130 to extend oppositely (FIGS. 7 and 9) and parallel to the tracks 11 at the height of the car coupler elements. This also lowers the lower coupler engaging assembly 38 to an inoperative, stored position in which it does not interfere with the operation of the upper coupler engaging assembly 40. Similarly, when the lower coupler engaging assembly 38 is in its operative position as shown in FIGs. 4 – 6 and the arm couplers 42 and 44 of the upper coupler engaging assembly 40 are swung together to their stored orientations (FIGS. 4 – 6), the upper coupler engaging assembly 40 is disposed and confined within a space less than the clear space between a pair of coupled railroads cars, as best shown in FIG. 4. When swung together to their stored orientations, the arm couplers 42 and 44 clear all projecting elements of adjacent coupled cars and do not interfere with raising and lowering of the car positioner arm 14.

To hold the arm couplers 42 and 44 in their stored orientations, they are respectively provided with pin-locking mechanisms 78 (only one being shown in FIG. 5). Each such mechanism cooperates with a plate 80 extending laterally to both sides of a vertical mounting plate 82 secured, as by welding, to the mounting block 46. The pin-locking mechanism includes a locking pin 86 that is mounted in a bracket 88 for manual sliding movement into and out of a hole 84 in the plate 80. A tethered cotter pin 90 may be provided to pass through a collar 92 of the bracket 88 and through the locking pin 86 for holding the locking pin 86 in its locking position.

Figure 7:
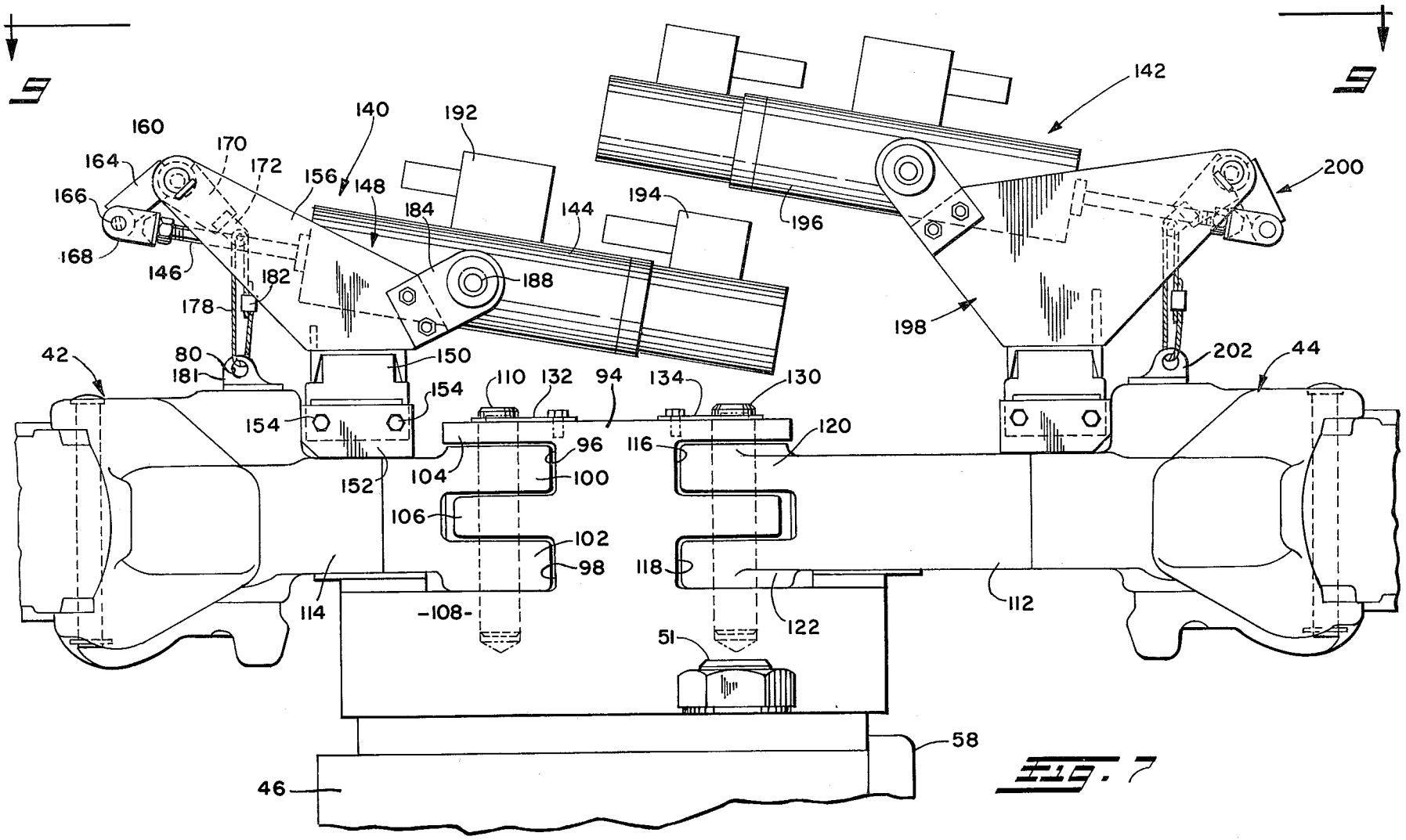
FIG. 7 is a fragmentary end elevation of the car engaging device of FIGS. 4 – 6, viewed as indicated by the line 7—7 in FIG. 5, and shows a pair of swingable arm couplers of the upper car engaging assembly swung to their oppositely extending positions for respectively engaging the couplers of uncoupled random cars while the other car engaging assembly is disposed in a lowered, inoperative position.
Figure 8:
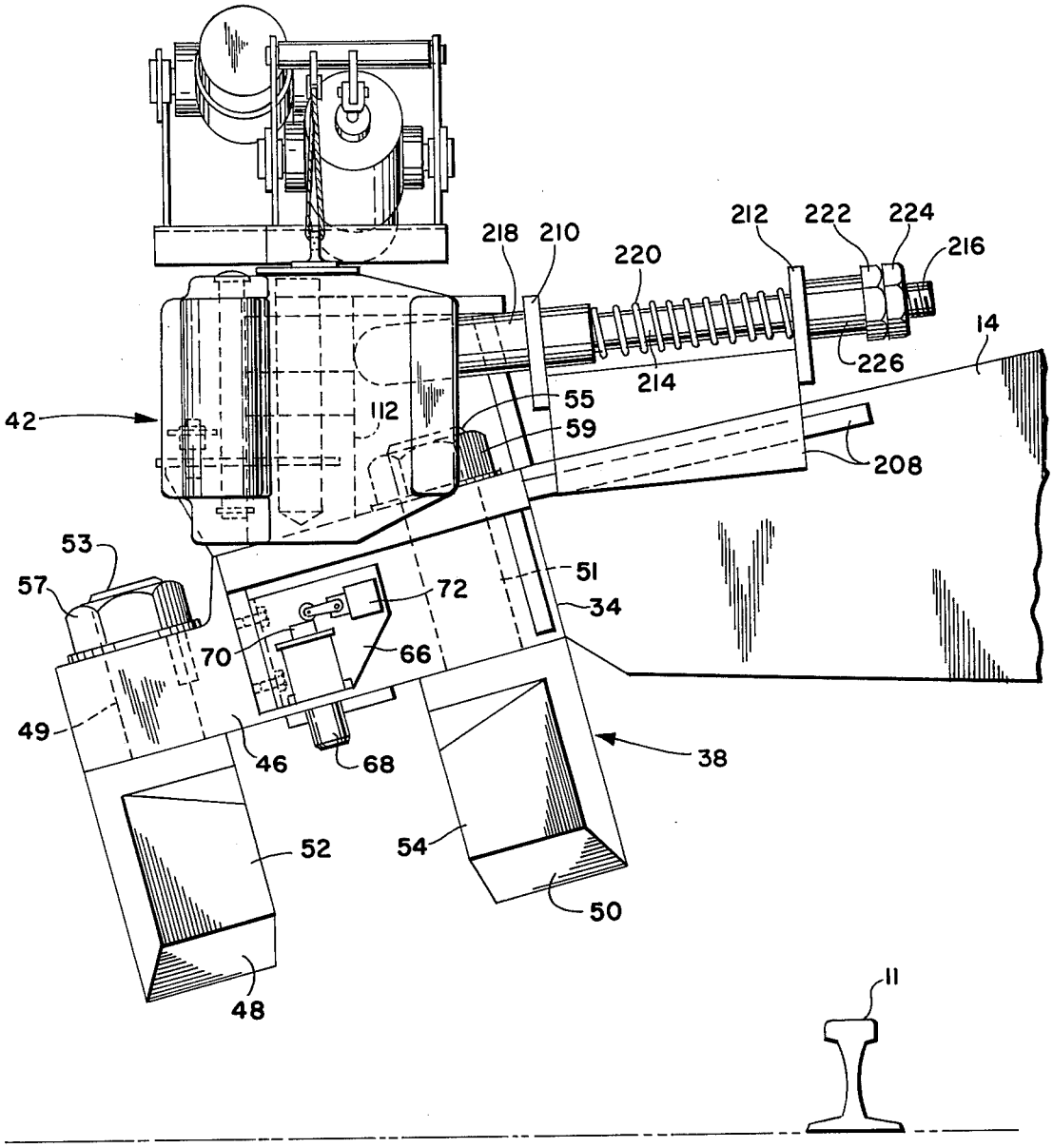
FIG. 8 is a side elevation of the car engaging device of FIGS. 4 – 6 with the two force transmitting assemblies disposed as in FIG. 7.
Figure 5:
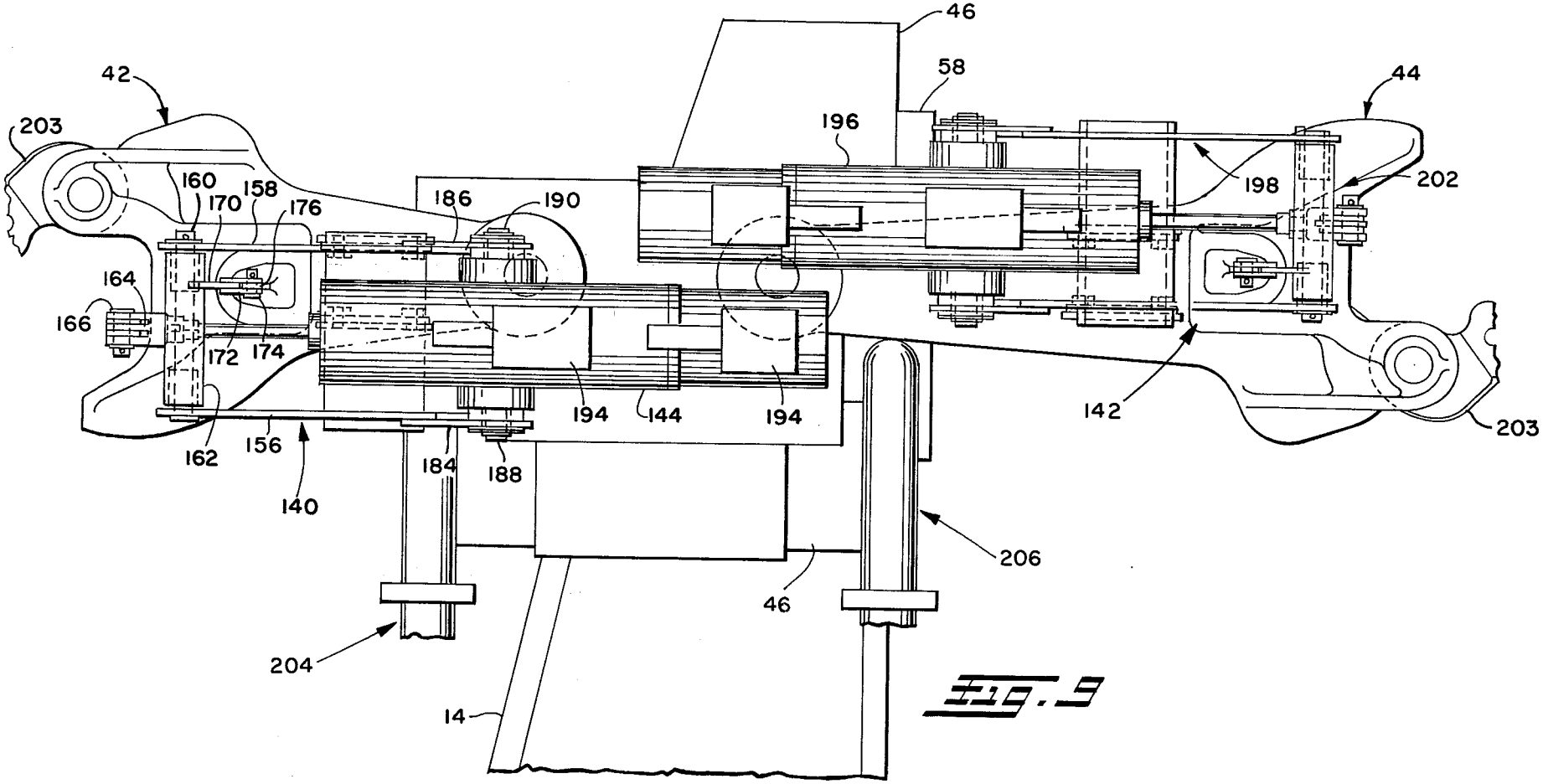

Referring now to FIGS. 7 and 9 showing the arm couplers 42 and 44 in their oppositely extended, operative positions, it will be noted that the arm coupler 44 is provided with a longer shank 112 than the shank 114 of the arm coupler 42. This permits closer positioning of the arm couplers 42 and 44 in a nested relationship when they are swung to their folded, inoperative orientations.

When the upper coupler engaging assembly 40 has been lowered to its operative position and the arm couplers 42 and 44 thereof have been manually extended to their operative, oppositely extending orientations, it is desirable that automatic means be provided for connecting and disconnecting each of the arm couplers with a mating coupler of a railroad car. For this purpose, a pair of coupler actuating mechanisms, generally designated 140 to 142, are respectively mounted on the arm couplers 42 and 44.

Referring to the coupler actuating mechanism 140 mounted on the arm coupler 42, it comprises an electrically operated actuator 144 of conventional design having an extensible arm 146 that is shown in FIG. 7 in its fully extended position. The actuator 144 is supported on a bracket assembly 148 that comprises a mounting block 150 secured to a support plate 152 by bolts 154. The support plate 152 is, in turn, suitably secured to the coupler arm shank 114, as by welding. A pair of similarly configured linkage support arms 156 and 158 are suitably mounted on the mounting block 150, as by welding, in laterally spaced relationship straddling the actuator 144. The extremities of the support arms 156 and 158 are spanned by a sleeve pin 160 having a sleeve 162 rotatably mounted thereon. A lever arm 164 is fixedly secured at one of its ends to the sleeve 162 and, at its opposite end, rotatably receives a pin 166 spanning the legs of a clevis 168 that is rigidly mounted on the projecting end of the extensible arm 146 of the electrical actuator 144. Also fixedly secured to the sleeve 162 is one end of a lever 170 having a clevis 172 at its opposite end. A pin 174 spanning the legs of the clevis 172 carries a sheave 176, and a wire rope 178 is reaved around the sheave 176 and through an eye 180 in a vertically movable coupler lock actuator 181 of a coupler lock lift assembly hereinafter described.

Also secured to the support arms 156 and 158 are cylinder support plates 184 and 186, respectively, which provide a trunion mount for the electrical actuator 144. Trunion pins 188 and 190 respectively extend laterally in opposite directions from the electrical actuator 144 and are rotatably received in the support plates 184 and 186, respectively.

Electrical control boxes 192 and 194 on the electrical actuator 144 house conventional controls for the electrical actuator and terminals for electrical power supply and signal wires employed in controlling the extension and retraction of the electrical actuators in response to signals received from a master controller (not shown) on the carriage 15.

In a generally similar arrangement, an electrical actuator 196 is trunion mounted on a bracket assembly generally designated 198, and a similar linkage system generally designated 200 operatively connects the electrical actuator 196 to a coupler lock actuator 202 for the arm coupler 44.

The arm couplers 42 and 44 are standard A.A.R. type "E" couplers having pivoted knuckles 203 that are locked in their closed positions when interlocked in coupled engagement with a standard car coupler element. Upon lifting of the coupler lock actuators 181 and 202 by actuation of the electrical actuators 144 and 196, respectively, the arm coupler knuckles 203 are unlocked for release from standard car coupler elements with which they may be engaged. Such release permits the knuckles 203 to be swung to their open positions shown in the drawings, whereupon the electrical actuators 144 and 196 are reversed, permitting the coupler lock actuators 181 and 202 return to their depressed positions while the coupler knuckles remain open. Upon endwise abutting engagement of the arm couplers with standard car coupler elements, the coupler knuckles 203 are cammed inwardly and are automatically locked in their closed positions to effect car coupling action, all as well understood by those skilled in the art.

Outward swinging movement of the arm couplers 42 and 44 to their oppositely extending operative positions is suitably limited by their engagement with spring-loaded abutments 204 and 206 (FIGS. 6 and 8) that are suitably mounted on opposite sides of the car positioner arm 14 as illustrated in detail for only the spring-loaded abutment 204. The illustrated mounting may suitably comprise an appropriately configured angular bracket 208 welded to the arm 14 and having spaced mounting plates 210 and 212 similarly secured thereto. The spring-loaded abutment may suitably comprise a rod 214 extending through the mounting plates 210 and 212, a threaded end 216 of the rod being restrained against movement in one direction by a pair of locking nuts 222 and 224 and a spacing collar 226. The opposite end of the rod 214 is enlarged at 218 and is in free sliding relationship with the mounting plate 210 and has a rounded bumper end for engagement with the shank 112 of the arm coupler 42. The rod 214 is biased by a spring 220 to cushion the shock of such engagement. The other spring-loaded abutment 206 is similarly mounted for coacting in the same manner with shank 114 of its associated arm coupler 42.

Considering the situation in which a unit train comprising a multiplicity of cars, such as 10*a* and 10*b* in FIG. 4, has been moved in coupled relationship along the tracks 11 by a yard engine or other locomotive (not shown), the train of cars is normally stopped with the lead car advanced toward the car dumper 12 at least to a point where the raised car positioner arm 14 on the carriage 15 at some point along its trackway 16 may be lowered between the second and third cars of the train, or between a subsequent pair of the cars as shown in FIG. 1. With the arm couplers 42 and 44 of the upper coupler engaging assembly 40 swung to their substantially parallel, stored orientations, the car positioner arm 14 is lowered until the coupler engaging assembly 38 engages the coupled coupler elements of the pair of cars in the manner shown in FIGS. 4 – 6. Such lowering of the car positioner arm is stopped upon actuation of the feeler element 68 to trip the limit switch 72. The carriage 15 is then advanced along its trackway 16 toward the car dumper 12 for advancing the train to move one or two lead cars into the dumper (according to the dumper capacity). The succeeding cycles of train advancement and car dumping may proceed automatically in accordance with a preset program as disclosed in the aforementioned U.S. Pat. No. Re. 27,300 to Ludwig.

Considering the situation in which a train of random cars has been moved into position on the tracks 11 for advancement by the car positioning apparatus into the car dumper 12, the train is stopped with the rear end of the second car (following the lead car) well within the range of travel of the carriage 15, but with the forward end of the lead car well short of the limit of carriage travel toward the car dumper 12. Assuming that only one car at a time may be accommodated in the car dumper, the carriage 15 of the car positioner is first run to a location ahead of the lead car; the car positioner arm 14 is lowered to its position shown in FIGS. 7 – 9; and the arm couplers 42 and 44 of the upper coupler engaging assembly 40 are swung to their oppositely extended, operative positions as there shown. The carriage is then moved rearwardly to couple the arm coupler 44 with the forward coupler element of the lead car; the second car is uncoupled from the third car; and the carriage is advanced slightly toward the dumper, pulling the lead car and second car to separate the latter from the third car. With forward movement of the carriage, the arm coupler 44 is uncoupled from the lead car; the arm 14 is raised; the carriage is moved rearwardly until the arm 14 is well behind the second car; the arm is lowered; the arm coupler 42 is coupled to the rear coupler element of the second car by forward movement of the carriage; and the carriage is advanced toward the car dumper to push the lead car to an unloading position therein. Thereupon, the lead car is uncoupled from the second car, and the carriage is moved rearwardly to separate the second car from the lead car, leaving the uncoupled lead car in the dumper. During cycling of the car dumper to dump the contents of the lead car, the arm coupler 42 is uncoupled from the second car; the carriage is moved rearwardly to couple the arm coupler 44 with the front coupler element of the third car; and the carriage is moved forwardly to advance the remainder of the train toward the dumper about one car length so that the forward end of the fourth car is within the limits of travel of the carriage. Then the third car is uncoupled from the fourth car, and the carriage is moved toward the dumper to move the third car toward the second car.

By operations similar to those just described, the car positioner arm 14 is disengaged from the front end of the third car, moved behind it, coupled to the rear coupler element thereof, and advanced toward the car dumper to advance and couple the third car to the second car. Upon completion of the dumping of the first car, the carriage is then further advanced toward the dumper to advance the third car and second car and couple the second car to the first car; and advancement of the carriage is then continued to push the first car through and out of the dumper. After uncoupling the emptied lead car, the carriage is moved to position the second car in the dumper. By successive repetitions of steps just described, each car in the train is moved into the dumper, emptied, pushed out of the dumper, and replaced by the next succeeding car until the entire train has been unloaded.

As will be evident from the foregoing description of the operation of a car positioner embodying the present invention, each successive pair of cars may be similarly handled as a single car so that two cars at a time may be moved in tandem into a twin car dumper until an entire train has been similarly unloaded.

From the foregoing description of an illustrative embodiment of the present invention and the operation thereof, it will be appreciated that an inproved car positioning apparatus has been provided that has greater versatility than prior art car positioners, making it possible, with the same apparatus, to handle the unloading of unit trains in the same manner and with the same facility as the apparatus of the prior Ludwig resissue patent and, also, to handle the unloading of a random car train, one or two cars at a time, with at least the same facility as any of the earlier car positioners of the prior art. Thus, instead of a single installation being limited to operation with only one kind of railroad cars, it may be equipped in accordance with the present invention to handle any cars commonly encountered in the rail transportation industry.

Although the present invention has been illustrated herein with reference to a particular, presently preferred embodiment thereof, it will be appreciated that it is not restricted to the slavish imitation of each and every detail set forth herein. Obviously, numerous variations thereof may be made without departing from the scope of the invention as defined in the appendant claims.

What is claimed is:

1. In a railroad car positioning apparatus for moving one or more railroad cars along a track portion and having a carriage disposed for movement parallel to said track portion, means for guiding said carriage alongside said track portion, a car positioner arm carried by said carriage and having a distal extremity dimensioned to be positioned between a pair of coupled railroad cars for force applying engagement therewith centrally thereof, and means for selectively moving said arm into and out of car pushing position, the improvement which comprises in combination on said arm means:

a. first force transferring means on said distal extremity for such force applying engagement between a pair of coupled railroad cars;

b. separate force transferring means on said distal extremity for such force applying engagement with either end of a single uncoupled railroad car;

c. means for shifting said force transferring means selectively to dispose either of them in its operative car pushing position, and the other in a stored inoperative position; and d. said separate force transmitting means in its stored inoperative position being sufficiently small to allow it to be positioned between coupled railroad cars without interference therewith.

2. The combination of claim 1 in which said separate force transferring means includes two coupler engaging heads swingable between storage positions and oppositely extending operative positions.

3. The combination of claim 2 wherein said two coupler engaging heads extend substantially parallel to each other and substantially perpendicular to the direction of said track portion when they are in said storage positions.

4. The combination of claim 1 in which the shifting means selectively disposes either of said force transferring means in its operative car pushing position by vertical displacement of said car positioner arm.

5. The combination of claim 1 in which the first force transferring means includes a plurality of depending means for pushing engagement with a coupled coupler.

6. The combination of claim 5 in which the depending means include at least a pair of coupler engaging fingers.

7. The combination of claim 1 in which the first force transferring means includes means for engaging a striker plate of a car.

8. The combination of claim 1 in which the first force transferring means engages a coupled coupler by resting on the upper surface thereof and includes depending means operative between the coupled coupler and the railroad car.

9. The combination of claim 1 in which the first force transferring means includes a mounting block carried by the distal extremity of said car positioner arm, a pair of coupler engaging fingers depending from said mounting block and adapted to abut a coupled coupler for transmitting a train moving force in one direction from the fingers to the coupled coupler, and means mounted on said mounting block for abutting a striker plate of at least one of a pair of coupled railroad cars for transmitting a train pushing force in the opposite direction.

10. The combination of claim 1 in which the separate force transferring means includes at least one arm coupler pivotally mounted at said distal extremity.

11. The combination of claim 10 wherein the arm coupler is pivotally mounted in superposed relation to the first force transferring means and for rotation in a plane parallel to the track portion.

12. The combination of claim 11 wherein two oppositely extendable arm couplers are so mounted.

13. The combination of claim 12 including means for retaining said arm couplers in folded positions within the space between a pair of coupled railroad cars.

14. The combination as set forth in claim 1 wherein said car positioner is operable in a first mode of operation to engage the couplers of coupled cars and move such coupled cars in either direction, and being operable in a second mode of operation to couple with an uncoupled coupler at either end of a car and to move such car in either direction.

* * * * *